United States Patent [19]

Difflipp et al.

[11] 4,270,450

[45] Jun. 2, 1981

[54] ARRANGEMENT FOR WASHING CYLINDERS ON PRINTING PRESSES

[75] Inventors: Kurt Difflipp, Dietzenbach; Harry M. Greiner, Offenbach am Main, both of Fed. Rep. of Germany

[73] Assignee: M.A.N.-Roland Druckmaschinen Aktiengesellschaft, Fed. Rep. of Germany

[21] Appl. No.: 73,661

[22] Filed: Sep. 10, 1979

[51] Int. Cl.[3] ..... B41F 35/06; B41F 9/01

[52] U.S. Cl. ..... 101/142; 101/425; 118/203

[58] Field of Search ..... 101/425, 423, 424, 136, 101/137, 141, 142, 132, 132.5; 15/256.52, 256.51; 118/203, 70

[56] References Cited

U.S. PATENT DOCUMENTS

| | | | |
|---|---|---|---|
| 2,145,630 | 1/1939 | Pilling | 15/256.52 |
| 3,120,805 | 2/1964 | Simon | 15/256.52 X |
| 3,155,035 | 11/1964 | Ritzerfeld et al. | 101/142 |
| 3,309,993 | 3/1967 | Grembecki et al. | 101/425 |
| 3,467,008 | 9/1969 | Domotor | 101/425 X |
| 3,630,148 | 12/1971 | Schinke et al. | 101/425 |
| 3,661,079 | 5/1972 | Stapleford | 101/142 |
| 3,772,991 | 11/1973 | Taguchi et al. | 101/415.1 |
| 3,976,007 | 8/1976 | Junghans et al. | 101/425 |

*Primary Examiner*—Edgar S. Burr

*Assistant Examiner*—C. A. Pearson

*Attorney, Agent, or Firm*—Leydig, Voit, Osann, Mayer & Holt

[57] ABSTRACT

A washing assembly for a lithographic press including a washing roller having a porous resilient surface for carrying a charge of cleaning fluid, the washing roller being mounted in a frame for rocking movement from a disengaged position to a first washing position in which the washing roller is engaged with the surface of the blanket cylinder and a second washing position in which the roller is engaged with the surface of the impression cylinder. A drive wheel is provided at the end of the blanket cylinder for coupling to a driven wheel at the end of the washing roller as the frame is rocked to its first washing position for differential driving of the washing roller to produce relative wiping against the surface of the blanket cylinder. A squeeze roller in pressing engagement with the washing roller prepares the surface of the washing roller to accept a fresh charge of cleaning fluid. In the preferred embodiment as used in a "five cylinder" press, first and second washing rollers are journaled on different portions of the same frame so that in the first washing position of the frame the washing rollers respectively engage the surfaces of separate blanket cylinders. The gap in the impression cylinder is spanned by a bridge to prevent the washing roller from falling into the gap.

10 Claims, 3 Drawing Figures

ARRANGEMENT FOR WASHING CYLINDERS ON PRINTING PRESSES

The blanket cylinders of a printing press must be periodically washed to remove accumulated ink and water-bound foreign matter including dust and lint from the paper. This is a time-consuming operation which must be performed more frequently these days because of the use of papers of inferior quality. Dust and lint tend to collect, as well, on the impression cylinders of the press so that these, too, require cleaning from time to time. It has been proposed to mechanize the washing process by providing a washing unit adjacent each cylinder but this has been found to be impractical because of cost and space considerations. As a result it is still the general practice to clean the cylinders by hand.

Accordingly, it is an object of the invention to provide a washing arrangement for a lithographic press for mechanically washing the press cylinders, as frequently as may be required, economically and with a miminum of down time. It is a related object to provide a washing arrangement which is highly efficient in the removal of lint and other foreign matter which tends to collect on the cylinders and which minimizes the time required per cleaning cycle even where the accumulation is in the semi-dried state.

It is another object of the invention to provide a washing assembly which is not limited to cleaning of a single cylinder but which has provision for manual rocking between a plurality of washing positions for washing adjacent ones of the cylinders in quick succession. In the preferred form of the invention it is an object to provide two separate washing rollers in the same washing assembly which may be brought into engagement with a pair of blanket cylinders for cleaning them simultaneously.

It is another object of the invention to provide a washing assembly in which the washing roller is positively driven by a wheel, or gear, on the blanket cylinder which is to be cleaned, with the drive connection being made as the washing assembly is brought into engagement with the blanket cylinder. The ratio of the drive is such that the washing roller operates at a differential surface speed, preferably in a direction opposite to the direction of movement of the surface on the blanket cylinder, to provide effective high speed wiping of the latter.

It is another object of the invention to provide a washing assembly having a pressurized source of cleaning fluid with means for turning on the source as the washing assembly approaches the blanket cylinder which is to be acted upon.

It is a more detailed object of the present invention to provide a washing assembly which has a source of cleaning fluid as well as a squeeze roller positioned in advance of the source so that the washing roller may take on a fresh charge of cleaning fluid upon each rotation.

It is still another of the invention to provide a washing assembly housed in a compact enclosure mounted upon a supporting frame to make a self-contained unit in which the cleaning fluid, although plentifully supplied, is shielded against spillage or gratuitous spraying within the press.

It is still another object of the invention to provide a washing assembly which acts with aggressive wiping action to remove accumulations of foreign material from a blanket cylinder but which acts more gently using a smaller amount of cleaning fluid in the cleaning of an adjacent impression cylinder which is less subject to contamination and where the full cleaning capability of the assembly would be inappropriate. Thus it is a related object of the invention to provide a cleaning assembly for a blanket cylinder and an adjacent impression cylinder in which each cylinder is automatically subjected to a different style of cleaning by the same machine automatically and without care or attention on the part of the operator.

It is another object, related to the foregoing, to provide a bridge across the gap of the impression cylinder so that there is no risk that the washing roller will fall into the gap upon rotation of the impression cylinder and as the assembly is manually swung in the direction thereof.

It is a general object of the invention to provide a washing arrangement for a lithographic printing press which is efficient, highly economical, easy to operate, which requires a minimum of space, and which is easily mounted within the structure of new presses and presses of existing design, indeed, presses already in the field, and which is, therefore, of universal application.

Other objects and advantages of the invention will become apparent upon reading the attached detailed description and upon reference to the drawings in which.

While the invention has been described in connection with a preferred embodiment it will be understood that we do not intend to be limited to the embodiment illustrated but intend, on the contrary, to cover the various alternative and equivalent constructions included within the spirit and scope of the appended claims.

Figure 1:
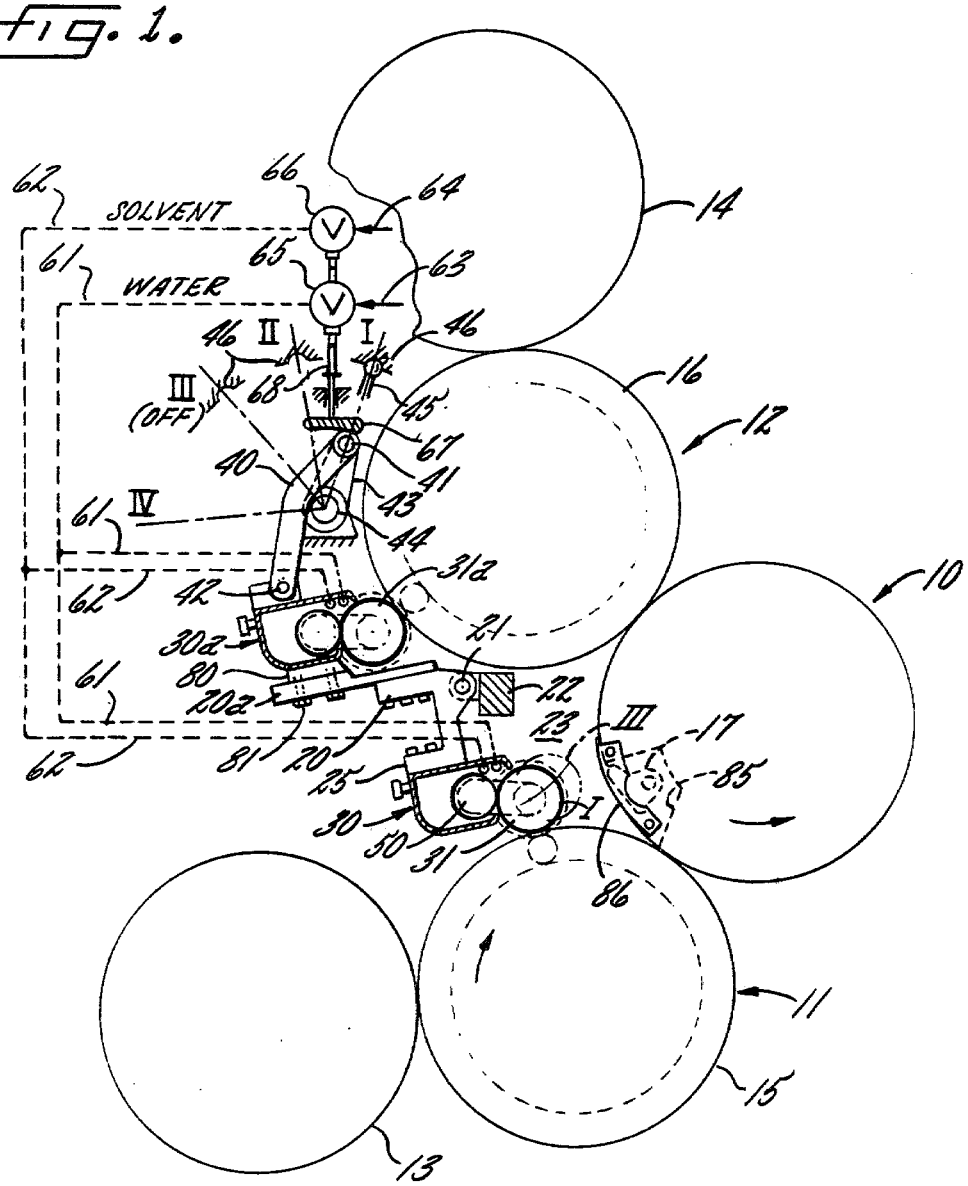
FIG. 1 is an elevational view, partly diagrammatic, showing a typical lithographic printing press employing the present invention.

Turning now to FIG. 1 there is shown a set of five cylinders capable of applying two successive printed impressions to a sheet. The cylinders include an impression cylinder 10 in rolling engagement with first and second blanket cylinders 11, 12 which are, in turn, in rolling engagement with plate cylinders 13, 14, respectively. It will be understood that the cylinders are all appropriately journaled in a pair of press frames, and driven, and that means are provided for applying a film of ink and film of moistening liquid to the plates on the cylinders 13, 14, such means being sufficiently well understood so that no illustration is necessary. Moreover, it will be understood that the cylinders 11, 12 carry resilient blankets 15, 16, respectively, capable of taking an "offset" impression from its associated plate and for transferring such impressions, in succession, to the surface of a sheet (not shown) wound about the impression cylinder, the leading edge of the sheet being held by a gripper 17. The means for synchronously opening, closing and re-opening the gripper for capture and release of a sheet is, again, conventional and need not be set forth.

It will be understood that after the press has been in operation for a certain length of time foreign material and in particular lint from the paper tends to collect upon the surfaces of the blanket cylinders because of the cyclical transfer of ink and moistening agent, the effect being to prevent a clear line of demarcation between the printing and non-printing areas with a loss of crispness in the printed impression. This requires that feeding of sheets through the press be temporarily discontinued so that the blanket cylinders may be cleaned. Even the impression cylinder 10, while it normally operates in a dry condition, will, after a period of normal running, collect a sufficient deposit of foreign material so as to make cleaning advisable. In the past such cleaning, particularly of the blanket cylinders, has been messy and extremely time consuming.

In accordance with the present invention a washing assembly is provided having a washing roller journaled in a frame, the frame being mounted for rocking movement to a first washing position in which the washing roller is engaged with the surface of one of the cylinders and a second washing position in which the washing roller is engaged with the surface of another one of the cylinders, with manually actuated means for moving the frame successively into its washing positions.

Thus we provide a frame 20 which is rockable about a hinge connection 21 on a cross beam 22. The cross beam is mounted in an access space 23 which is defined by the two blanket cylinders 11, 12, which are in opposed relation, and the adjacent impression cylinder 10. Secured to the lower end 25 of the frame member 20, and forming a part thereof, is a first washing unit 30 journaling a first washing roller 31.

Figure 2:
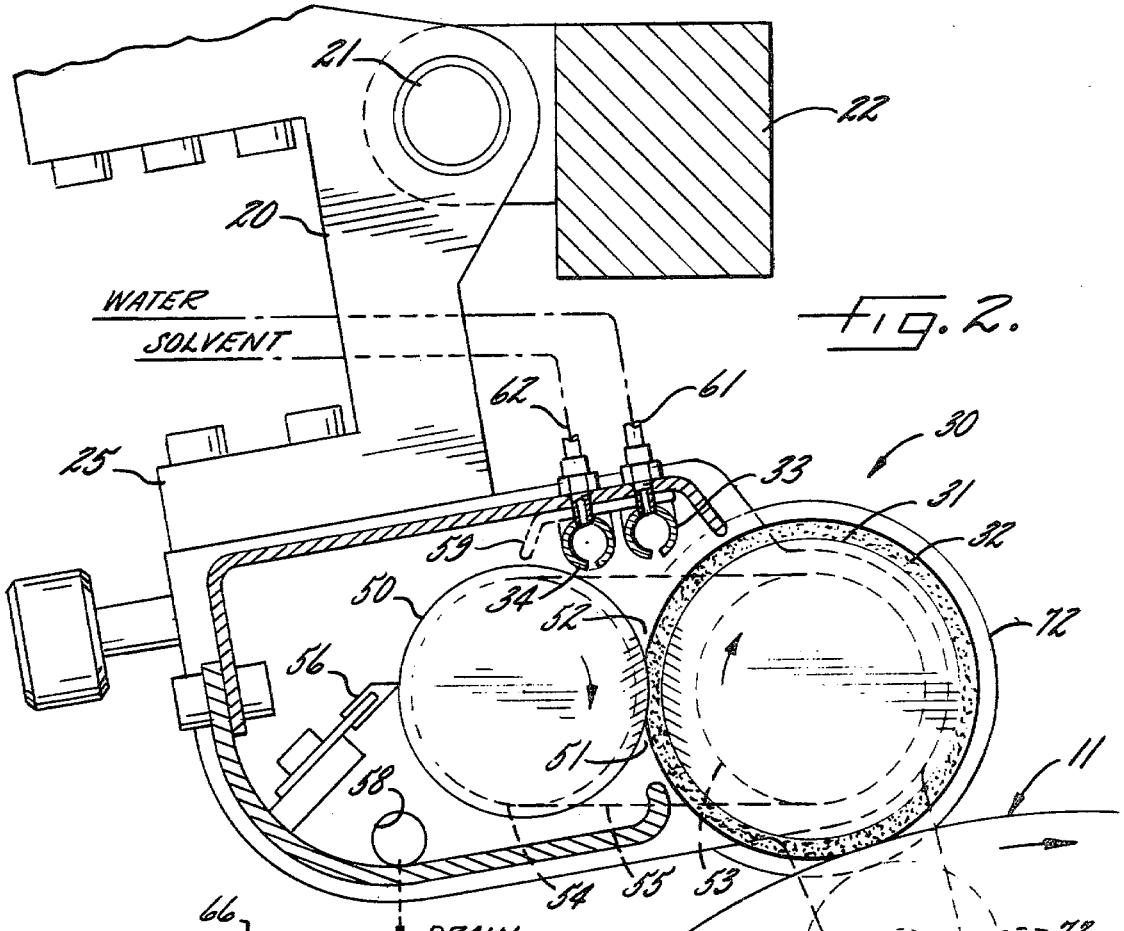
FIG. 2 is an enlarged vertical section taken through one of the washing units disclosed in FIG. 1 and showing the driving means for the washing roller.

For the details of the washing unit 30 reference is made to FIG. 2 where it will be noted that the washing roller 31 has a surface layer 32 which is both porous and resilient for carrying a charge of cleaning fluid. Cleaning fluid is supplied from nozzles 33, 34 which have spaced openings distributed over the length of the washing roller.

For the purpose of rocking the frame 20 so that the washing roller 31 is moved between its washing positions, a toggle link 40 is provided having an upper pivot 41 and a lower pivot 42. The upper pivot is connected to a crank 43 supported upon a crank shaft 44. A manually operated throw arm 45, connected to the shaft, serves to rock the crank through the angular positions indicated at I–IV, detents 46 being provided to hold the swing arm 45 in a set position until intentionally released.

As illustrated in FIG. 1, the washing roller 31 is in running engagement with the surface of the blanket cylinder 11, which will be referred to as the "first" washing position. Rotating the swing lever 45 into position III establishes a disengaged condition in which the washing roller is not in contact with either of the cylinders 10, 11. Continuing the movement of the lever 45 into position IV causes the crank 43 to rock the frame 20 in the counterclockwise direction into the "second" washing position illustrated in FIG. 3 in which the washing roller 31 engages the surface of the impression cylinder 10.

By moving the washing roller 31 from its position I to position IV both the cylinders 11, 10 may be cleaned in quick succession, following which the swing arm 45 is restored to its disengaging position III until next required.

Means are provided in the washing unit 30 for squeezing the porous resilient layer 32 thereby to squeeze out the used cleaning fluid and prepare the surface layer 32 to accept a fresh charge of fluid. This is preferably accomplished by a squeeze roller 50, suitably journaled in the frame and which is in contact with the "back side" of the washing roller 31. The squeeze roller 50 is of relatively hard material such as metal with its surface in indenting relation to the layer 32. The two rollers, together, define a lower, or expelling, nip 51 and an upper or absorbing nip 52. The nozzles 33, 34 which discharge the cleaning fluid are preferably located above the upper nip.

In accordance with one of the aspects of the invention the washing roller 31 is drivingly coupled to the squeeze roller 50 so that the outer surface of the latter moves in a direction contrary to the surface of the washing roller; in other words, the surface of the squeeze roller moves downwardly while the surface of the washing roller moves upwardly at the region of contact. This is accomplished by a drive pulley 53 which drives a driven pulley 54 on the squeeze roller by means of a belt 55. The counter rotation serves to discharge the used fluid downwardly from the nip 51.

For the purpose of maintaining the surface of the squeeze roller in a clean condition, and particularly for the purpose of constantly scraping off any lint or paper dust which might collect thereon, a doctor blade 56 is provided, extending along the entire length of the roller.

An enclosure, which forms part of the frame 20, encloses the squeeze roller 50 and the source of cleaning fluid and at least partially encloses the washing roller 31 so that only a portion of the cylindrical surface extends for engagement with the respective cylinders 10, 11. A drain opening 58 is provided at the bottom or sump portion of the enclosure preferably communicating with a flexible drain hose (not shown). An optional baffle 59 extends the length of the enclosure. Such a buffle is particularly useful where the nozzles 33, 34 are oriented to discharge upwardly to create turbulence in the space above the upper nip 52, the baffle serving to prevent undue loss of the cleaning fluid over the backside of the squeeze roller.

Attention may next be given to the means for furnishing the cleaning fluid to the nozzles 33, 34. Preferably the cleaning fluid is formed of two components, water which enters nozzle 33 via a line 61 and solvent which enters nozzle 34 via a line 62. The lines are supplied from pressurized sources diagrammatically indicated at 63, 64, respectively via interposed valves 65, 66.

In accordance with one of the aspects of the present invention means are provided for turning on the source of cleaning fluid as the frame approaches its first washing position in which the washing roller is presented to the blanket cylinder. In the illustrated embodiment such means is in the form of a cam follower member 67 having a push rod 68. The cam follower 67 is located in the path of movement of the outer end of the crank 43 as it successively moves between positions II and I. The valves 65, 66 are mounted for triggering in sequence so that as the crank moves into position II the valve 65 is opened causing water to flow through line 61 and nozzle 33. As the crank is rotated clockwise into its final position I, corresponding to the first washing position, valve 66 is progressively opened causing solvent to be added to the stream, the solvent flowing through line 62 and nozzle 34.

After the surface of the blanket cylinder 11 has been thoroughly washed, the manual rocking member 45 is retracted into position III. As the rocking lever, and the crank 43 which is connected to it, begin to move the solvent is first cut off followed, at position II, by cut off of the water supply.

In accordance with one of the important aspects of the present invention a drive wheel is provided at the end of the blanket cylinder 11 for rotation therewith and a driven wheel is provided at the end of the washing roller 31 so that when the frame is rocked into its first washing position I the driven wheel is coupled to the drive wheel for rotation of the roller, the drive ratio being such that the washing roller has a differential surface speed to produce relative wiping of the washing roller against the surface of the blanket cylinder. Further in accordance with the invention an idler wheel is interposed between the drive wheel and driven wheel so that the surface of the washing roller wipes the blanket in a direction which is opposite to the direction that the blanket is moving.

Thus a drive wheel 71 is provided on the blanket cylinder for driving a driven wheel 72 on the washing roller with the idler 73 interposed between the two. The idler 73 is mounted on a shaft 74 which is carried by a suitable bracket 75 which is fixed to, and which forms an extension of, the supporting frame 20.

While the driving elements 71–73 may be in the form of friction-surfaced wheels, the term "wheels" is intended to be generic to use of spur gearing, the pitch diameters of the gears corresponding to the wheel diameters. Spur gears provide more positive driving, but regardless of whether smoothly surfaced wheels or spur gears are used, driving of the washing roller and squeeze roller occurs automatically as the washing unit is brought into engagement with the blanket cylinder.

Figure 3:
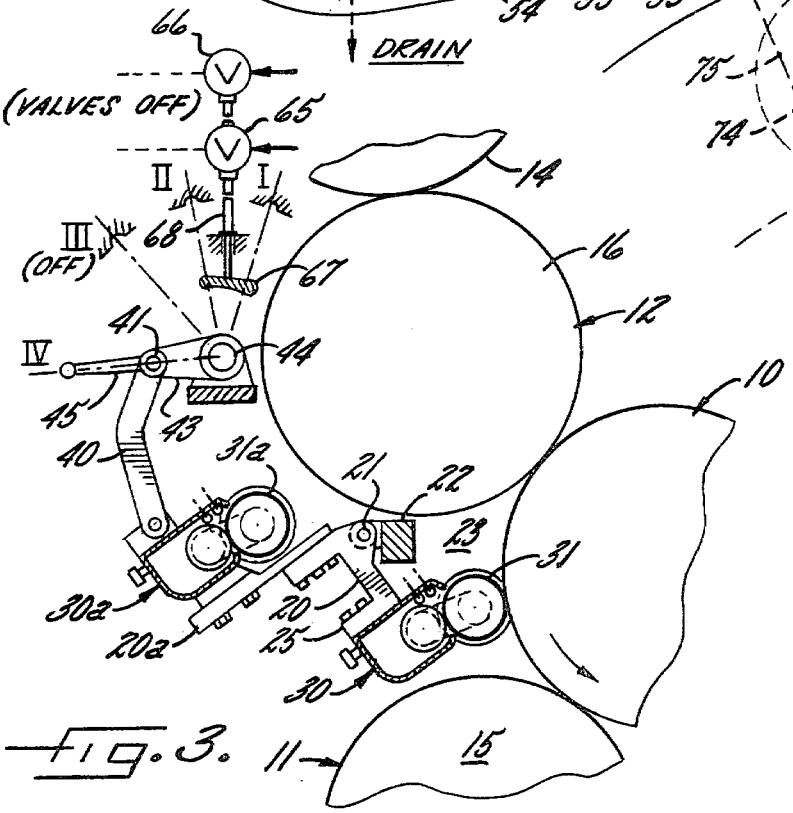
FIG. 3 is a fragmentary view showing the washing apparatus in its second washing position.

Although pressure discharge of cleaning fluid and positive wiping, or scrubbing, action of the washing roller is desirable on the blanket to remove the encrustation in the shortest possible time, it is one of the features of the present device that positive differential driving of the washing roller is not used when the mechanism is in its second washing position in contact with the impression cylinder as shown in FIG. 3. In its second washing position the outer porous and resilient layer of the washing roller, dampened with cleaning fluid, simply rolls with slightly indented engagement against the surface of the blanket on the impression cylinder, free of any scrubbing action, to lift off the accumulated but relatively loose particles of lint and other foreign matter which may have accumulated in the dry state. It is found that such cleaning action is optimum for the impression blanket, prolonging its useful life.

The invention is particularly applicable in a so-called five-cylinder press having first and second blanket cylinders in rolling engagement with a single impression cylinder, with the blanket cylinders engaging the same side of the impression cylinder so as to provide an access space between them. Thus is accordance with the preferred form of the invention a frame is provided, centrally pivoted in the access space, having a first washing roller journaled on its inner portion, as already described, and having in addition a second washing roller journaled in the outer portion of the frame so that when the frame is in its first washing position the washing rollers simultaneously engage the surfaces of the associated blanket cylinders. For this purpose a second washing unit **30*a* is provided, with the elemements of the unit and its drive corresponding to the unit 30 previously described and with corresponding elements being indicated by corresponding reference numerals with addition of subscript "a". The unit 30*a* is mounted upon an outer portion 20*a* of the frame 20**.

For the purpose of providing individual adjustability of the unit **30*a* in the lateral direction, the unit is mounted upon a pedestal 80 which is slidable on the frame member 20*a* in a direction inwardly and outwardly of the blanket cylinder 12 and clamped in a final adjusted position by one or more clamping bolts 81. The adjustment is such that when the swingable arm 45 is swung to position I illustrated in FIG. 1, the washing rollers 31, 31*a* engage their associated blanket cylinders to equal degree. Because of the fact that the washing units 30, 30*a*** are swung in unison by the same linkage, pressurized water and solvent will be admitted to each of them simultaneously as they approach the first washing position and the driving means will be simultaneously engaged. It is seen, then, that by use of the invention swinging of a single frame results in the cleaning of three separate cylinders, something heretofore not achieved in this art, with one of the cylinders being reached for cleaning even though deepy recessed in a position normally considered inaccessible.

In the above discussion the layer 32 on the washing roller has been characterized as both porous and resilient. Porosity is desirable so that the layer might carry a charge of cleaning fluid to the surface of the blanket cylinder where the wiping or scrubbing action occurs. The feature of resiliency is desirable to insure contact and uniformity of action over the entire length of the washing roller and to permit the used fluid to be squeezed out and replaced by a fresh charge as a result of the action of the nozzles and squeeze roller. In the preferred form of the invention the washing rollers **31, 31*a* have a layer at 32** which is of composite construction consisting of a first layer of resilient plastic material of 8 mm. thickness over which is stretched an absorbent cloth sleeve of about 2 mm. thickness raising the diameter of the complete roller to approximately 60 mm. The plastic has a hardness rating of approximately 5 to 15 Shore.

However, the invention is not limited thereto and if desired the layer may be discontinuous in the form of closely spaced "tufts" of resilient absorptive material; or, if desired, the layer may be in the form of radially directed fibers such as characterize the material known as mohair or may be in the form of a brush formed of closely spaced bristles of a common height.

Also while the use of separate sources and nozzles for water and solvent is preferred, it will be understood that the invention may be practiced if desired, and in simpler form, by use of a single source of a cleaning fluid "mix" fed through a single nozzle and under the control of a single valve without departing from the invention.

In use the swingable lever 45 occupies the detented off position III. The lever is manually grasped and moved through position II to the first washing position I. As the crank 43 traverses position II and proceeds to position I the valves 65, 66 are opened in succession for discharge of water and solvent. A delay device such as a dashpot may be associated with the valve 66 so as to delay the application of solvent until after the washing rollers **31, 31*a*** have completed a number of revolutions on their respective blankets, the water thus serving to prepare the blanket surface for the subsequent application of the solvent.

After the lever has been left in its first, detented position long enough for cleaning to occur, a matter well within the skill of the art and generally lasting no more than a fraction of a minute, the lever is withdrawn from position I and retracted through position II thereby turning off the valves. The lever is moved through the off position III into the second washing position IV in which the washing roller 31 is in dampened condition and in free rolling engagement with the blanket on the impression cylinder. Since the impression cylinder normally has a rather wide gap, indicated at 85, arcuate bridges 86 are preferably secured to the ends of the impression cylinder but in the path of the washing roller, the bridges serving to span the gap to prevent the washing roller from dropping into the gap during each rotation. As shown, the bridges bulge beyond the surface of the impression cylinder slightly to provide clearance for the gripper 17.

While the manual swing lever 45 has been shown for swinging the crank 43 through its range of positions, which has the advantage of providing a sense of "feel" for the press operator, it will be understood that the invention is not limited thereto and, if desired, the crank 43 may be operated by means of a manually actuated power servo device between its successive positions. The latter has the advantage of requiring minimum manual effort and actuation from a convenient operating position which may be remote from the washing mechanism.

The term "cleaning fluid" as used herein shall mean any fluid capable of softening or dissolving of accumulation of ink plus foreign material. The roller cleaning solvent furnished by Bottcher Company in Cologne, West Germany is preferred. This is a hydrophobic substance requiring pre-application of water, as described. The term "detent" as used herein shall mean any means for temporarily retaining the frame in a selected position. The term "differential speed" refers to speeds which differ either in magnitude or in direction. "Manually actuated" includes manually induced triggering.

What we claim is:

1. In a lithographic press the combination comprising a blanket cylinder and an impression cylinder, a washing assembly having a frame, the washing assembly including a washing roller journaled in the frame as well as a source of pressurized cleaning fluid for the roller, the roller having a porous resilient surface layer for carrying a charge of cleaning fluid, the frame having means for mounting the same for rocking movement from a disengaged position to a first washing position in which the washing roller is engaged with the surface of the blanket cylinder and a second washing position in which the washing roller is engaged with the surface of the impression cylinder for rotation at the same surface speed free of slippage, means for positively driving the washing roller at a differential surface speed while it is in its first washing position resulting in slippage at the engaged surfaces, manually actuated means for moving the frame successively into its washing positions, and means for causing said washing roll to be in a relatively less wet condition when it is in its second washing position, said means including an automatically engaged valve for turning on the source as the frame approaches its first washing position and for turning off the source as the frame leaves its first washing position.

2. The combination as claimed in claim 1 in which the cleaning fluid has two components and in which there are separate pressurized sources therefor, and means for turning on the sources in succession automatically as the frame approaches its first washing position and for turning off the sources as the frame is retracted from its first washing position.

3. In a lithographic press the combination comprising a blanket cylinder and an impression cylinder, a washing assembly having a frame, the washing assembly including a washing roller journaled in the frame as well as a source of cleaning fluid for the roller, the roller having a porous resilient surface layer for carrying a charge of cleaning fluid, the frame having means for mounting the same for rocking movement from a disengaged position to a first washing position in which the washing roller is engaged with the surface of the blanket cylinder and a second washing position in which the washing roller is frictionally engaged with the surface of the impression cylinder, manually actuated means for moving the frame successively into its washing positions, a drive wheel at the end of the blanket cylinder for rotation therewith, a driven wheel at the end of the washing roller so that when the frame is rocked to its first washing position the driven wheel is coupled to the drive wheel for rotation of the roller, the drive ratio being such that the washing roller has a differential surface speed relative to the blanket cylinder to produce relative wiping of the washing roller against the surface of the blanket cylinder, the frictional engagement with the surface of the impression cylinder causing the washing roller to rotate at the same surface speed as the impression cylinder free of slippage thereon when said frame is rocked to its second washing position.

4. In a lithographic press the combination comprising a plurality of cylinders in running engagement, a washing assembly having a frame, the washing assembly including a washing roller journaled in the frame as well as a source of cleaning fluid for the roller, the roller having a porous resilient surface layer for carrying a charge of cleaning fluid, a squeeze roller journaled in the frame in pressing engagement with the washing roller and positioned in advance of the source of cleaning fluid thereby to prepare the surface layer of the washing roller to accept a fresh charge of cleaning fluid, driving means for drivingly coupling the squeeze roller to the washing rolls so that their engaged surfaces move in opposite directions, the frame having means for mounting the same for rocking movement from a disengaged position to a first washing position in which the washing roller is engaged with the surface of one of the cylinders and a second washing position in which the washing roller is engaged with another one of the cylinders, manually actuated means for moving the frame successively into its washing positions and means for causing said washing roll to be in a relatively less wet condition when it is in its second washing position, said means including an automatically engaged valve for turning on the source as the frame approaches its first washing position and for turning off the source as the frame leaves its first washing position.

5. In a lithographic press the combination comprising first and second blanket cylinders in rolling engagement with a single impression cylinder, the blanket cylinders engaging the same side of the impression cylinder so as to form a relatively narrow access space between them, a washing assembly having a swingable frame pivoted in the access space for rocking movement about a horizontal axis, a washing roller journalled on the frame and having a source of cleaning fluid, the roller having a porous resilient surface layer for carrying a charge of the cleaning fluid, the frame having an off position in which the washing roller is idly disengaged from the cylinders, the frame being swingable from the off position into a first washing position in which the washing roller engages the surface of one of the blanket cylinders, driving means for the washing roller engageable when the frame is swung into its first washing position for positively driving the washing roller at a differential surface speed relative to the blanket cylinder to cause slippage between the washing roller and the engaged surface of the blanket cylinder, the frame being swingable from the off position into a second washing position in which the washing roller is disengaged from the blanket cylinder and from the drive means for the washing roller and in which the washing roller is swung inwardly of the access space into frictional engagement with the surface of the impression cylinder for non-slip rotation at the same surface speed as the impression cylinder, and manually actuated means for moving the frame successively into its washing positions.

6. In a lithographic press the combination comprising first and second blanket cylinders in rolling engagement with a single impression cylinder, the blanket cylinders engaging the same side of the impression cylinder so as to provide an access space between them, a washing assembly having a swingable frame, first and second washing rollers on the frame and having a source of cleaning fluid, the rollers each having a porous resilient surface layer for carrying a charge of cleaning fluid, the frame being pivoted at its center about a horizontal axis in the access space to define inner and outer swingable portions, the first and second washing rollers being journaled relatively in the inner and outer portions of the frame so that when the frame is in the first washing position the washing rollers simultaneously engage the surfaces of the blanket cylinders, the frame being rockable into a second washing position in which the washing rollers are disengaged from the blanket cylinders and in which the first washing roller is swung inwardly of the access space into washing engagement with the impression cylinder, and manually actuated means for moving the frame successively into its washing positions.

7. The combination as claimed in claim 6 in which means are provided in at least the first washing position for establishing a driving connection between each washing roller and its engaged cylinder, the driving connections having a drive ratio such that the washing rollers are driven at a differential surface speed to produce relative wiping of the washing rollers against the surfaces of the respectively engaged cylinders.

8. The combination as claimed in claim 6 in which at least one of the washing rollers is movably mounted for lateral adjustment with respect to the frame to insure equalized simultaneous engagement of the blanket cylinders by the respective rollers.

9. The combination as claimed in claim 6 in which hold-in means including a detent are provided for temporarily retaining the frame in its first washing position until intentional release.

10. The combination as claimed in claim 6 in which the impression cylinder includes a gap with a bridge spanning the gap in the cylinder so arranged that the washing roller rides over the bridge upon rotation of the impression cylinder thereby to avoid falling into the gap.

* * * * *

UNITED STATES PATENT AND TRADEMARK OFFICE

CERTIFICATE OF CORRECTION

PATENT NO. : 4,270,450

DATED : June 2, 1981

INVENTOR(S) : Kurt Difflipp, Harry M. Greiner and Johannes Wanke

It is certified that error appears in the above—identified patent and that said Letters Patent is hereby corrected as shown below:

On the face of the patent, under identification [75], after "Kurt Difflipp, Dietzenbach; Harry M. Greiner, Offenbach am Main," insert --Johannes Wanke, Offenbach am Main,--;

On the face of the patent, under identification [75], delete "both" and substitute therefor --all--;

Column 4, line 36, delete "buffle" and substitute therefor --baffle--;

Column 5, line 56, delete "is" and substitute therefor --in--;

Column 5, line 65, delete "elemements" and substitute therefor --elements--.

Signed and Sealed this

*Sixth* Day of *October 1981*

[SEAL]

*Attest:*

GERALD J. MOSSINGHOFF

*Attesting Officer*

*Commissioner of Patents and Trademarks*